US005642597A

United States Patent [19]

Hendrickson

[11] Patent Number: 5,642,597

[45] Date of Patent: Jul. 1, 1997

[54] DRYWALL MOUNTING BRACKET

[76] Inventor: Gary J. Hendrickson, 10 Meetinghouse Rd., Carlisle, Pa. 17013-1728

[21] Appl. No.: 667,608

[22] Filed: Jun. 21, 1996

[51] Int. Cl.[6] ..... E04B 1/38

[52] U.S. Cl. ..... 52/715; 52/489.1

[58] Field of Search ..... 52/712, 714, 715, 52/483.1, 489.1

[56] References Cited

U.S. PATENT DOCUMENTS

| | | | |
|---|---|---|---|
| 1,609,541 | 12/1926 | Gooding . | |
| 1,694,043 | 12/1928 | Thomson . | |
| 1,800,075 | 4/1931 | Imrie . | |
| 2,452,645 | 11/1948 | Firsel . | |
| 2,468,437 | 4/1949 | Foley . | |
| 2,490,018 | 12/1949 | Davis . | |
| 3,127,961 | 4/1964 | Frazier . | |
| 3,206,806 | 9/1965 | Powell . | |
| 3,276,179 | 10/1966 | Rallis . | |
| 3,331,180 | 7/1967 | Vissing et al. | 52/715 X |
| 3,722,166 | 3/1973 | McNerney . | |
| 3,741,068 | 6/1973 | Andruskiewicz . | |
| 4,199,907 | 4/1980 | Bains et al. . | |
| 4,283,892 | 8/1981 | Brown . | |
| 4,608,794 | 9/1986 | Delise . | |
| 4,766,707 | 8/1988 | Knudson | 52/715 X |
| 4,925,141 | 5/1990 | Classen . | |
| 4,932,173 | 6/1990 | Commins . | |
| 4,949,929 | 8/1990 | Kesselman et al. . | |
| 4,976,085 | 12/1990 | Krueger . | |
| 5,203,640 | 4/1993 | Pourtau et al. . | |
| 5,257,483 | 11/1993 | Netek | 52/712 X |

FOREIGN PATENT DOCUMENTS

| | | | |
|---|---|---|---|
| 2348684 | 4/1974 | Germany | 52/712 |

*Primary Examiner*—Carl D. Friedman
*Assistant Examiner*—Yvonne Horton-Richardson
*Attorney, Agent, or Firm*—Terrance L. Siemens

[57] ABSTRACT

A bracket for providing support for paneling which is customarily nailed or screwed to framing. The bracket comprises a base panel for receiving drywall screws and a support panel for nailing to framing. The base panel has a foraminous surface for promoting penetration by drywall screws and a reinforcing flange disposed at an angle to the base panel. The support panel is disposed perpendicularly to the base panel, and has preformed apertures for accepting nails to secure the bracket to framing. A tab is punched from the base panel and folded over so as to be coplanar with the base panel and perpendicular to the support panel. The bracket has a T-shaped configuration when viewed in end elevation. The support panel forms the stem of the T, and is topped on one side by the base panel and on the other side by the tab.

5 Claims, 4 Drawing Sheets

DRYWALL MOUNTING BRACKET

BACKGROUND OF THE INVENTION

1. Field of the Invention

The present invention relates to a bracket for mounting sheets of prefabricated plasterboard or drywall to the frame of a wall or partition during construction, modification, or rehabilitation of a building. The bracket is nailed or otherwise fastened to wall or partition studs in locations requiring but lacking nailing surfaces for fastening drywall sheets to the studs. Installation of several brackets thus provides a surface for supporting drywall fasteners which previously could not be employed for lack of a nailing surface or the like. Drywall is then fastened in place by screwing drywall screws through the drywall and into the bracket.

2. Description of the Prior Art

In construction or rehabilitation of a building, it is common practice to erect an open wooden frame, which frame is then finished by erection of a finishing surface. Prefabricated panels provide convenient and economical components for covering large wall areas with relatively minimal expense in time and material. In much residential and commercial construction today, plasterboard has gained favor as a desirable construction material for finishing interior walls and partitions.

Since framing occurs prior to finishing, the finishing trade is dependent upon framing carpenters to anticipate the needs of drywall installers. However, although framing carpenters are generally well aware of this dependency, for many reasons, framing is occasionally inadequate for installation of surface paneling. An inexperienced or hurried carpenter may fail to recognize or make the effort to provide sufficient wooden studs for nailing or screwing paneling to the wooden frame. Other trades may have modified a frame for their particular purpose, and failed to accommodate drywall installers. A homeowner performing his or her own work may lack necessary experience to recognize or anticipate the need for nailing surface. Regardless of the cause, drywall installers regularly are faced with the necessity of adding to available nailing surface.

A typical response by drywall installers to this need, in those instances when it arises in the course of construction, is to nail an auxiliary piece of lumber to the unfinished frame. However, this is not always easily performed. In many instances, the drywall installer lacks sufficient space to swing a hammer effectively, and the auxiliary lumber cannot be effectively fastened to the frame. Even where adequate auxiliary support members can be installed onto existing framing, this work may prove quite time consuming, difficult, and tiring.

The prior art has suggested many clips, brackets, and other hardware for enabling attachment to and joining of diverse construction elements. An L-shaped, perforated joining element is described in U.S. Pat. No. 3,127,961, issued to Bob G. Frazier on Apr. 7, 1964. This element lacks a reinforcing flange and tabs projecting from the two principal panels forming the ell, as are found in the present invention. Frazier's device also lacks a foraminous surface promoting penetration by a fastener, as provided in the instant invention.

U.S. Pat. No. 1,694,043, issued to Charles M. Thomson on Dec. 4, 1928, describes a wall attachment device which is in alternative embodiments L- or Z-shaped. This device lacks the reinforcing flange and preformed fastener apertures of the present invention. It also lacks a foraminous surface, different from that having preformed apertures, for promoting penetration of fasteners.

A generally L-shaped fastener is described in U.S. Pat. No. 2,490,018, issued to Homer C. Davis on Dec. 6, 1949. This device lacks the reinforcing flange and foraminous surface of the present invention. It also lacks the tab of the present invention, which, if added to Davis's device would prevent Davis's device from occupying a corner, as intended by Davis.

U.S. Pat. No. 3,741,068, issued to Julian Andruskiewicz on Jun. 26, 1973, describes a wallboard staple having a principal panel from which depend a second panel and two pointed piercing members. By contrast, the present invention has members projecting at an angle to the principal panel from both sides, rather than from just one side, as seen in the device of Andruskiewicz. Also, the device of Andruskiewicz lacks a foraminous surface for promoting penetration by fasteners.

A stud particularly intended for supporting plasterboard is shown in U.S. Pat. No. 1,609,541, issued to James C. Gooding on Dec. 7, 1926. However, the stud has generally complicated construction incorporating a metal shell providing at least three sides of a quadrilaterally bounded column. By contrast, the present invention has two perpendicular principal panels. Dimensionally minor projections from the two principal panels of the present invention are different from the three sided metal shell of Gooding.

None of the above inventions and patents, taken either singly or in combination, is seen to describe the instant invention as claimed.

SUMMARY OF THE INVENTION

The present invention provides a bracket which is intended to be nailed or screwed to a nailing surface of a framing member, and which has the effect of extending the framing member around a corner to a location suitable for fastening drywall paneling to a supporting surface, where that location has not been reached by framing. This is accomplished by nailing the bracket to an exposed or accessible nailing surface of the framing.

The bracket is configured generally L-shaped, having a base panel and a fastening panel which are perpendicularly disposed to one another. The fastening panel has apertures preformed therein, so that it may be readily nailed to the accessible surface of the framing. The base panel provides a support surface disposed perpendicularly to the nailing surface of the accessible framing member. A drywall panel is laid against and abuts the support surface, and is fastened thereto by drywall screws or the like which are driven into the base panel. The base panel has a dimpled or foraminous surface, for promoting penetration by drywall screws. In summary, the bracket is nailed to framing at an accessible surface of the framing while providing a supporting surface disposed perpendicularly to that employed to nail the bracket to the framing.

Two relatively minor members project from the bracket. The base panel is slightly bent along its outer edge to define a flange for opposing bending or deformation of the plane of the base panel. This flange is relatively unobtrusive, and plays a further role in mounting of the drywall panel in that it enables ready alignment of the bracket when manually placed against framing lumber. In addition to the flange, a tab projects from the bracket in a manner coplanar with the base panel.

When viewing the bracket from an end, the fastening panel forms the stem of a tee completed or topped by the coplanar base panel and tab. However, the tab is much shorter than the base panel, so that overhang of the top of the tee is not equal on both sides of the stem. The tab provides a stop enabling the bracket to be aligned with one surface of a framing member, thereby assuring correct location of the drywall panel.

The novel bracket is especially suited for modifying framing after completion of the framing phase of construction. It is easily nailed to framing in situations wherein nailing a relatively large and bulky piece of lumber is difficult or awkward. At the same time, the structure of the bracket is extremely compact, compared to lumber, while providing virtually equivalent support for mounting drywall.

The bracket is employed in plural short segments. Any appropriate number of brackets is employed to provide periodic fastening supports along an unsupported edge of a panel of drywall. Resultant ready modification of framing to accommodate mounting of drywall greatly expedites finishing work where framing is inadequate to give proper support for screwing drywall panels in place.

Accordingly, it is a principal object of the invention to provide a bracket for extending framing where framing is inadequate to give proper support for screwing drywall panels in place.

It is another object of the invention to enable nailing of a support for paneling to an accessible surface of framing while providing a support surface disposed perpendicularly to the nailing surface.

It is a further object of the invention to provide a stop enabling aligning of the bracket with a surface of a framing member.

Still another object of the invention is to provide preformed apertures for receiving nails, thereby expediting nailing of the bracket to framing.

An additional object of the invention is to render the base panel easily susceptible to penetration by drywall screws.

It is again an object of the invention to prevent bending or deformation of the plane of the surface of the member which supports drywall.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
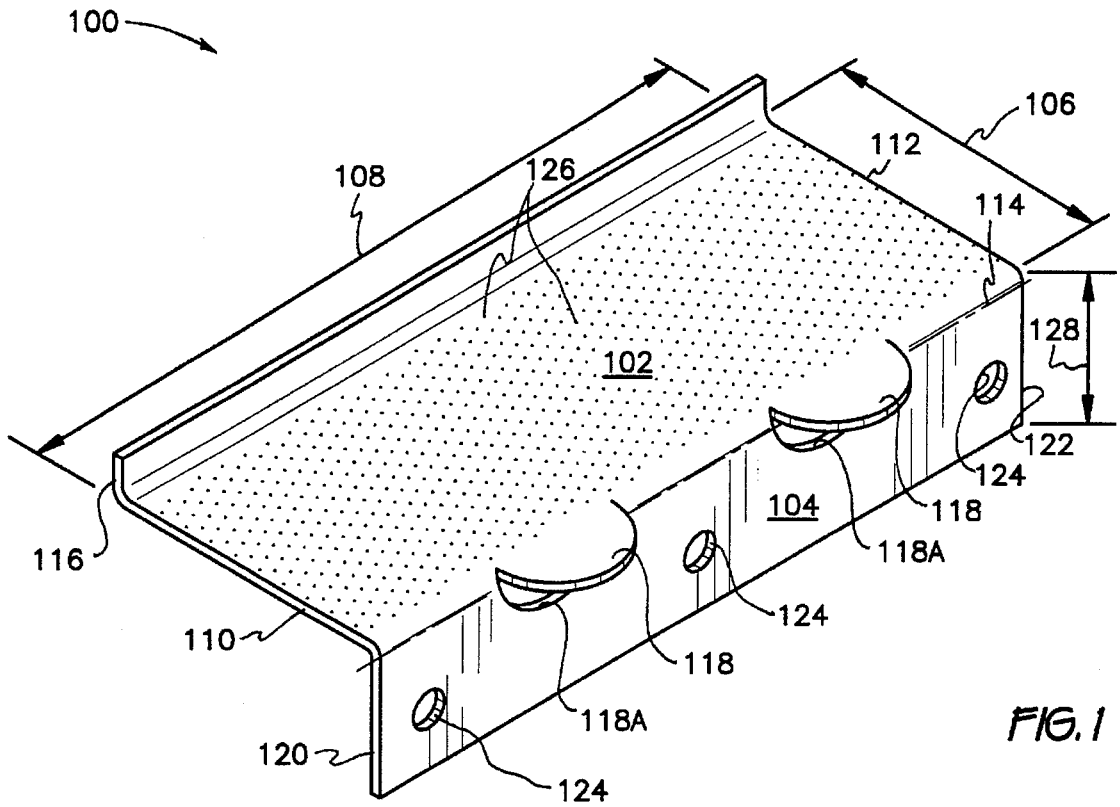
FIG. 1 is a perspective view of the invention.

Turning now to FIG. 1 of the drawings, novel paneling attachment bracket 100 is seen to comprise a flat base panel 102 and a flat fastening panel 104 arranged perpendicularly to and depending from base panel 102. Base panel 102 has a depth direction and dimension 106 and a width direction and dimension 108. Depth dimension 106 and width dimension 108 will be understood to be arbitrarily defined, for purposes of relating subsequently mentioned components. Base panel 102 provides the function of engaging paneling (shown in subsequent figures) and for receiving fasteners (shown in subsequent figures) fastening the paneling to bracket 100.

Base panel 102 is characterized by having first and second lateral edges 110, 112 generally aligned with arrow 106 indicating the depth dimension of bracket 100, a joint 114 indicated in broken line, and a reinforcing flange 116 disposed generally parallel to width dimension 108 and projecting upwardly from base panel 102. Joint 114 is an arbitrary designation of a fold or bend line existing as an abstraction, and forms a transition between base panel 102 and fastening panel 104. Joint 114 is preferably disposed parallel to width dimension 108 and located on a lateral side of base panel 102 opposite that bearing flange 116.

Base panel 102 has two flat extensions 118 disposed in coplanar relation with base panel 102. Extensions 118 are connected to and extend from base panel 102 at joint 114. Preferably, two extensions 118 are provided, and are spaced apart from one another so that bracket 100 may be aligned with respect to square cut framing lumber, as will be described hereinafter. If formed by punching from fastening panel 104, then it will be apparent that formation of extensions 118 will leave voids 118A in fastening panel 104 which voids 118A correspond in configuration and complement their respective extensions 118. This construction does not impair overall strength of bracket 100, and serves to minimize weight of bracket 100 and to enable ready fabrication.

It is contemplated that bracket 100 will be formed by punching and bending from sheet metal stock, such as twenty-five gauge steel, although other materials may be selected. Sheet metal has requisite strength, and is thin and flat, for enabling drywall to be mounted without displaying unsightly bulges or offset due to material thickness of bracket 100. If sheet metal stock is selected for fabrication, then bracket 100 may be formed starting from a quadrilateral section of stock, and bent and punched to incorporate the features described herein.

Fastening panel 104 provides a member for fastening bracket 100 to a framing member, as will be shown hereinafter. Fastening panel 104 is joined to base panel 102 at joint 114 and depends from base panel 102, as contrasted with upturned flange 116, these relationships being shown in FIG. 1. Fastening panel 104 is disposed perpendicularly to base panel 102 for cooperation with square cut framing lumber, and is thus also perpendicular to extensions 118.

If fabricated from rectangular sheet stock, fastening panel 104 has a lateral edge 110 occupying a plane in common with lateral edge 110 of base panel 102 and a lateral edge 112 occupying a plane in common with lateral edge 112 of base panel 102. A plurality of apertures 124 for receiving fasteners are formed in fastening panel 104. Preferably, three apertures 124 are provided, one being centered with respect to width dimension 108, or equidistantly from edges 110 and 122. The other apertures 124 are located, respectively, spaced apart from but in close proximity to edges 110 and 122.

Since bracket 100 is nailed to a visible and accessible framing member, apertures 124 may be preformed therein and arbitrarily located thereon. However, after installation of bracket 100 and placement of drywall paneling over bracket 100, bracket 100 is obscured. Precise location of a drywall screw is difficult at best, and would be time consuming even if possible. Therefore, preformed individual holes for receiving drywall fasteners are not provided. Instead, base panel 102 has a dimpled or foraminous surface providing many depressions 126 periodically located on the undersurface of panel 102, as seen in FIG. 1. Depressions 126 may, of course, comprise holes extending entirely through panel 102. As employed herein, provision of either dimples or perforations extending entirely through the material of base panel 102 will be referred to as foraminous.

Depressions 126 both reinforce base panel 102 and also tend to prevent the sharp point of a drywall screw from excessive wandering. These characteristics promote penetration of a drywall screw through base panel 102. Therefore, a drywall screw is readily driven into base panel 102 at any convenient location, and no obscured hole need be precisely located when fastening drywall paneling to bracket 100.

Figure 2:
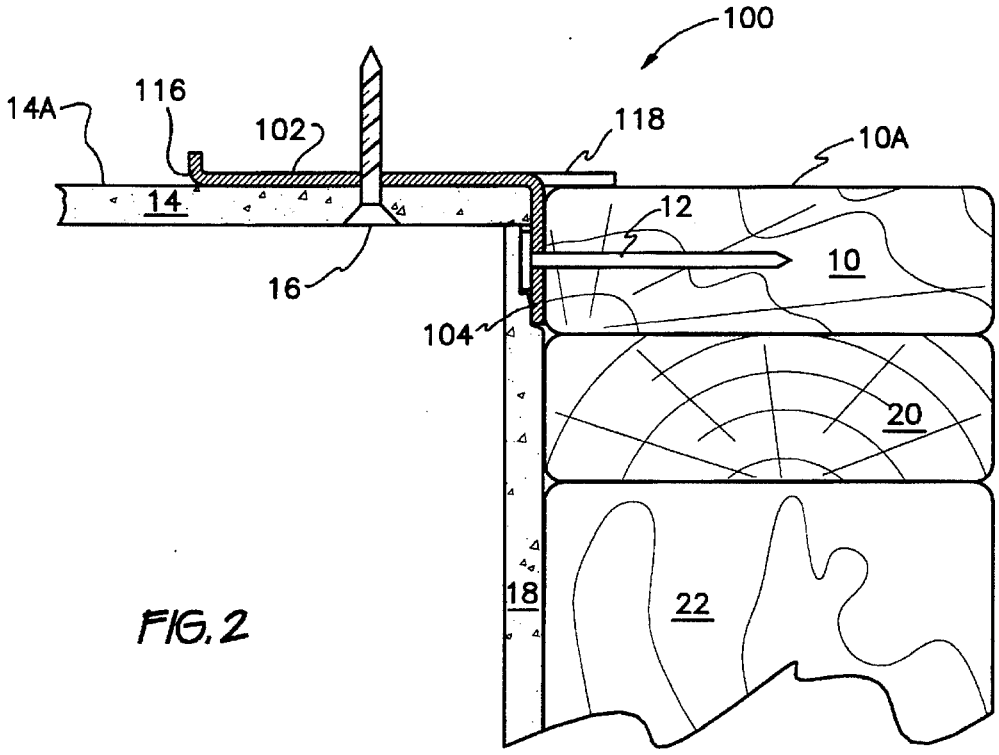
FIG. 2 is an environmental, side elevational view of the invention, shown partially broken away to reveal concealed detail.

Having described construction of bracket 100, methods of use and advantages of bracket 100 will now be set forth. Referring first to FIG. 2, bracket 100 has been secured to a framing header 10 by nails 12. Subsequently, drywall panel 14 is placed against base panel 102 of bracket 100 and secured in this location by drywall screw 16. Of course, several screws 16 are driven into bracket 100, only one being visible in the view of FIG. 2.

After securement of drywall panel 14, a second drywall panel 18 is installed. In the situation depicted in FIG. 2, panel 18 is conventionally installed, and is shown merely to illustrate cooperation with panel 14 and framing members 10, 20, and 22, which are typical of framing construction. In this typical construction, there are no other framing members near those shown. Therefore, there is no interference encountered by the exposed section of screw 16 or of reinforcing flange 116. It should be noted at this point that there would indeed be interference if flange 116 were bent to the same side of panel 102 as that from which fastening panel 104 depends.

The role of extensions 118 becomes clear in FIG. 2. Immediately prior to nailing to header 10, bracket 100 is moved into abutment with header 10. When fastening panel 104 contacts header 10, bracket 100 is forced downwardly until abutment of extensions 118 with header 10 ensues. At this point, bracket 100 is located so that face 14A of drywall panel 14 is flush with face 10A of header 10. Bracket 100 thus provides the effect extending face 10A to the left of header 10.

Figure 3:
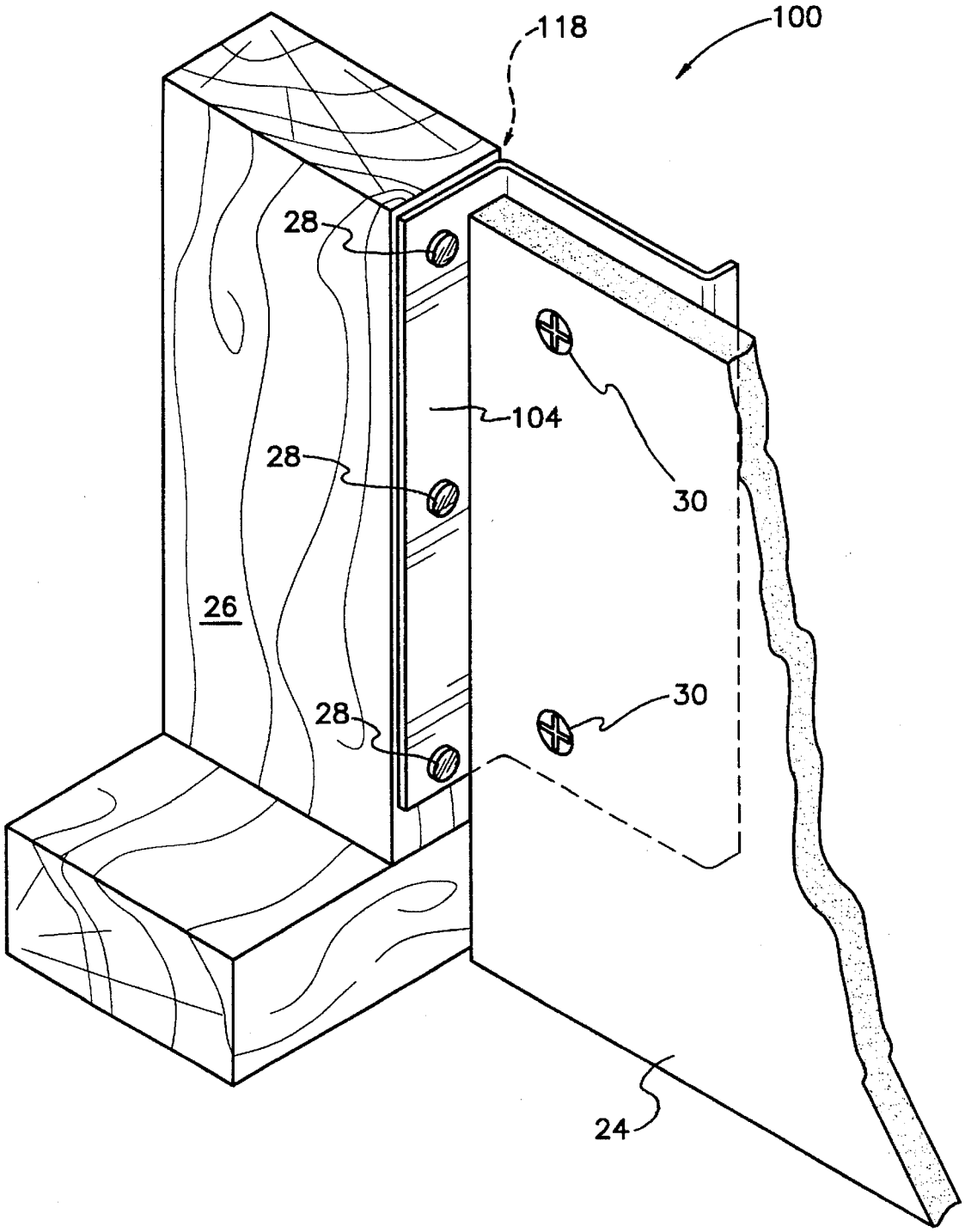
FIG. 3 is an environmental perspective view of the invention, with the novel bracket shown partially in phantom for clarity.

Turning now to FIG. 3, a vertically oriented section of drywall panel 24 is shown secured to vertical stud 26 by bracket 100. Nails 28 for securing bracket 100 to stud 26 are shown in this embodiment, but may in other embodiments be more centrally located within fastening panel 104. In these other embodiments, nails 28 could possibly be obscured by panel 24. Heads 30 of drywall nails are visible after being driven through panel 24 and bracket 100. Once again, bracket 100 has been placed in solid abutment with stud 26 by pressing fastening plate 104 and extensions 118 against two faces of stud 26.

Figure 4:
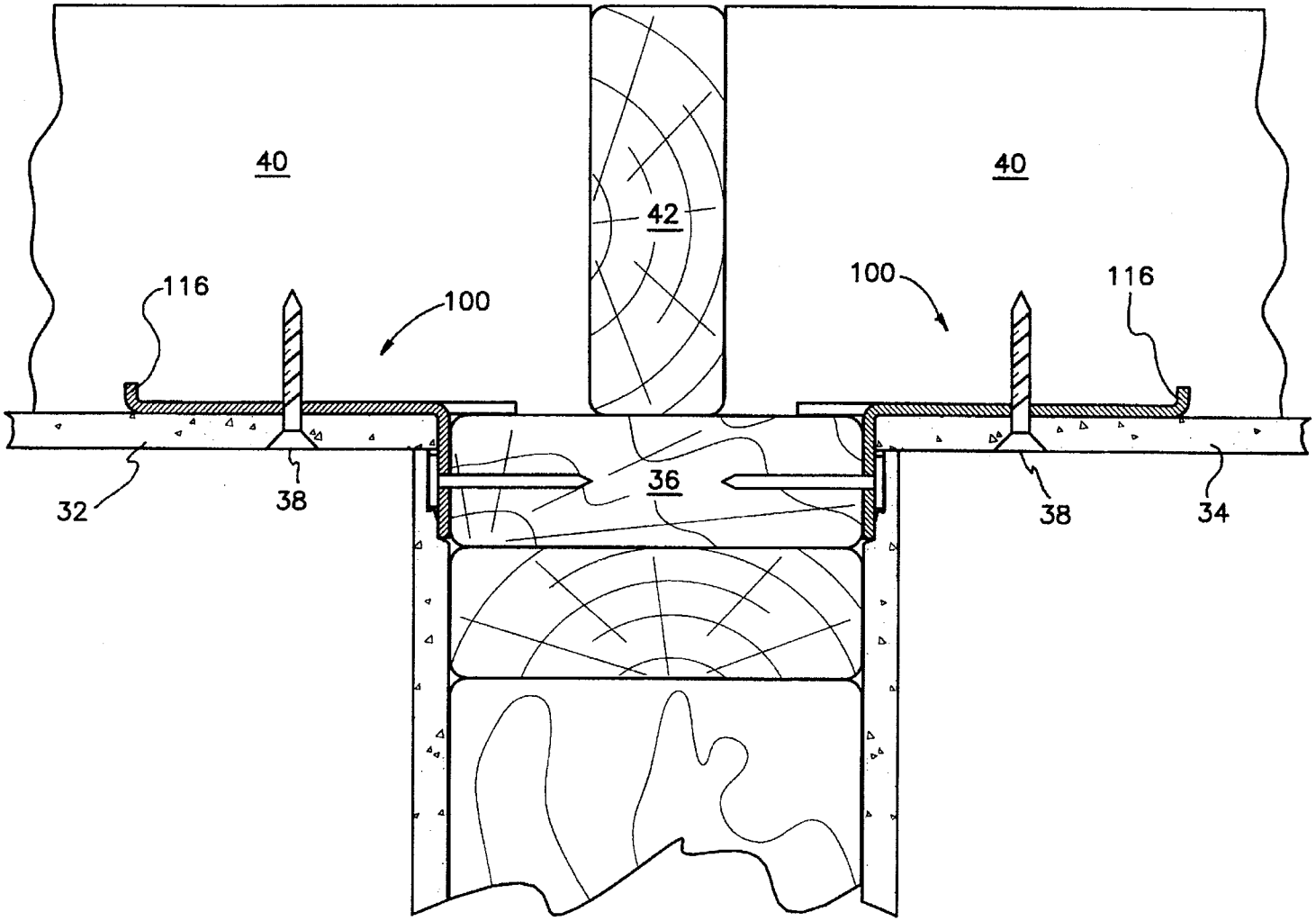
FIG. 4 is an environmental, top plan view of the invention, with parts of the novel bracket and of environmental elements broken away to reveal concealed detail.

FIG. 4 shows vertically oriented drywall panels 32 and 34 fastened to a stud 36 by two brackets 100. Drywall screws 38 and flanges 116 avoid interference with footer 40 by virtue of being located above footer 40, projecting instead into a void existing above footer 40 and to the right and left of stud 42. FIG. 4 shows that brackets 100 may be inverted, so that one configuration is usable on both right and left sides of stud 36.

Figure 5:
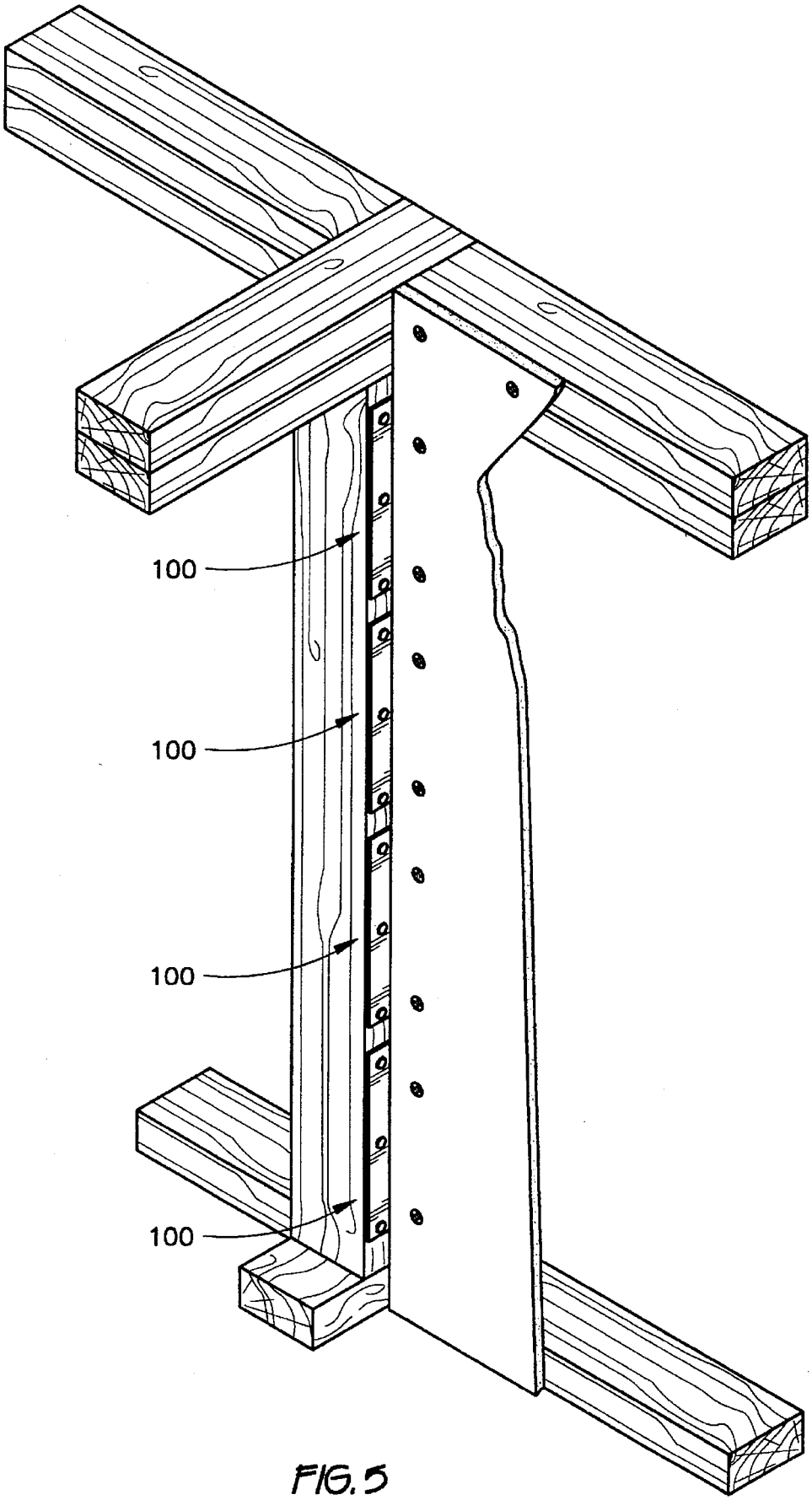
FIG. 5 is an environmental, perspective view of the invention.

FIG. 5 shows an installation employing a plurality of brackets 100, illustrating representative spacing thereof. Brackets 100 are preferably formed in one foot widths, which is a convenient width for building walls and partitions which are typically six to eight feet in height above a floor. Preferably, depth dimension 106 (see FIG. 1) and a corresponding depth dimension 128 (see FIG. 1) of fastening panel 104 are less than one and seven eighths inches, which dimension corresponds to an actual dimension of a nominal two inch dimension of commonly available framing lumber. Limitation of depth dimensions 106 and 128 assures that bracket 100 will not protrude beyond the various faces of a nominal two inch by four inch framing member. This framing member is the minimal size commonly employed in structural framing of buildings in the United States today. Of course, the preferred dimensions set forth above could be varied to accommodate other building standards or situations.

It will be apparent to one of ordinary skill in the art that construction and utilization of the invention may be modified and varied while retaining the original features and purpose. Obviously, bracket 100 is suitable for installing any type of paneling, not just of the drywall type, which paneling is fastened to a supporting surface by nailing, screwing, stapling, tacking, or by any other process employing a sharpened fastener or even an adhesive.

As is apparent, the quadrilateral section need not be rectangular, as there is little necessity that edges 110 and 112 be parallel to one another or normal to width dimension 108. The various edges, although shown and described as essentially linear, may be irregular or disposed at various angles not shown to one another. Further, materials and fabrication techniques need not be as described prior. Bracket 100 may be fabricated from other metals or materials, such as synthetic resin or fiberglass. Bracket 100 may be molded, or fabricated in still other ways.

It is to be understood that the present invention is not limited to the embodiments described above, but encompasses any and all embodiments within the scope of the following claims.

I claim:

1. A paneling attachment bracket for supporting paneling on a frame, comprising:

a flat base panel for engaging paneling and for receiving fasteners fastening the paneling to said bracket, said base panel having a depth dimension, a width dimension, first and second lateral edges generally aligned with said depth dimension, a reinforcing flange disposed parallel to said width dimension and projecting upwardly from said base panel, and a joint disposed parallel to said width dimension and located on a lateral side opposite that of said flange;

a flat extension disposed in coplanar relation with respect to said flat base panel, said extension connected to and extending from said bracket at said joint of said flat base panel; and a flat fastening panel
joined to said base panel at said joint,
disposed perpendicularly to said extension and to said base panel and depending from said base panel,
having a third lateral edge occupying a plane in common with said first lateral edge of said base panel and a fourth lateral edge occupying a plane in common with said second lateral edge of said base panel, and
having a plurality of apertures for receiving fasteners.

2. The paneling attachment bracket according to claim 1, said plurality of apertures of said fastening panel including a first aperture formed in said fastening panel equidistantly from said first and second lateral edges, a second aperture formed in said fastening panel, said second aperture spaced apart from said first lateral edge in close proximity to said first lateral edge, and a third aperture formed in said fastening panel in close proximity to said second lateral edge.

3. The paneling attachment bracket according to claim 1, said base panel having a foraminous surface, for promoting penetration by a driven fastener.

4. The paneling attachment bracket according to claim 1, said base panel having means defining a void corresponding in configuration to and complementing said extension, whereby said paneling attachment is fabricated from a quadrilateral sheet of material by bending and punching operations.

5. A paneling attachment bracket for supporting paneling on a frame, comprising:

a flat base panel for engaging paneling and for receiving fasteners fastening the paneling to said bracket, said base panel having
a depth dimension,
a width dimension,
first and second lateral edges generally aligned with said depth dimension,
a reinforcing flange disposed parallel to said width dimension and projecting upwardly from said base panel, and
a joint disposed parallel to said width dimension and located on a lateral side opposite that of said flange, and
a foraminous surface, for promoting penetration by a driven fastener;

a flat extension disposed in coplanar relation with respect to said flat base panel, said extension connected to and extending from said bracket at said joint of said flat base panel, said base panel having means defining a void corresponding in configuration to and complementing said extension, whereby said paneling attachment is fabricated from a quadrilateral sheet of material by bending and punching operations; and a flat fastening panel
joined to said base panel at said joint,
disposed perpendicularly to said extension and to said base panel and depending from said base panel,
having a third lateral edge occupying a plane in common with said first lateral edge of said base panel and a fourth lateral edge occupying a plane in common with said second lateral edge of said base panel, and
having a plurality of apertures for receiving fasteners including a first aperture formed in said fastening panel equidistantly from said first and second lateral edges, a second aperture formed in said fastening panel, said second aperture spaced apart from said first lateral edge in close proximity to said first lateral edge, and a third aperture formed in said fastening panel in close proximity to said second lateral edge.

* * * * *